US007780353B2

(12) United States Patent
Yoffe

(10) Patent No.: US 7,780,353 B2
(45) Date of Patent: Aug. 24, 2010

(54) BAG FOR RETAINING WARMTH AND CRISPINESS OF FOOD ITEMS AND PROCESS THEREFOR

(75) Inventor: Itzhak Yoffe, Savion (IL)

(73) Assignee: Mibaplast Ltd., Holon (IL)

( * ) Notice: Subject to any disclaimer, the term of this patent is extended or adjusted under 35 U.S.C. 154(b) by 1079 days.

(21) Appl. No.: 11/397,278

(22) Filed: Apr. 4, 2006

(65) Prior Publication Data

US 2006/0222271 A1 Oct. 5, 2006

(30) Foreign Application Priority Data

Apr. 14, 2005 (IL) ..... 168044

(51) Int. Cl.
*B65D 33/01* (2006.01)
*B65D 30/08* (2006.01)
*B65D 30/20* (2006.01)

(52) U.S. Cl. ..... 383/101; 383/102; 383/109; 383/120

(58) Field of Classification Search ..... 383/100, 383/101, 102, 109, 120
See application file for complete search history.

(56) References Cited

U.S. PATENT DOCUMENTS 3,217,970 A 11/1965 Lokey
3,507,443 A * 4/1970 George ..... 383/103
3,628,720 A 12/1971 Schmedding
4,797,010 A 1/1989 Coelho et al.
4,861,957 A * 8/1989 Welles ..... 219/730
4,866,786 A * 9/1989 Nagler ..... 383/101
5,227,599 A * 7/1993 Mason et al. ..... 219/730
5,346,312 A 9/1994 Mabry et al.
6,019,511 A * 2/2000 Thomas et al. ..... 383/113
6,187,396 B1 2/2001 Moller
2003/0079824 A1 5/2003 Colgan

FOREIGN PATENT DOCUMENTS

DE 527204 6/1931
WO WO 02/42060 5/2002

* cited by examiner

*Primary Examiner*—Jes F Pascua
(74) *Attorney, Agent, or Firm*—Roach Brown McCarthy & Gruber, P.C.; Kevin D. McCarthy

(57) ABSTRACT

A bag for retaining the warmth and crispiness of food items contained therein is disclosed. The bag is made of cellulose-based, oven-durable outer and inner plies that are adhesively affixed together by adhesive layers, a bag interior defined by adjacent faces of the inner ply, and at least one pocket formed between the outer and inner plies defined by adjacent adhesive layers. The outer and inner plies are pierced with a plurality of apertures such that the apertures pierced within the outer ply are offset from the apertures pierced within the inner ply by a predetermined dimension. Due to a temperature differential, vapors emitted by a warmed food item inserted in the bag interior are driven into each one pocket and remain within the corresponding pocket for a useful period of time. A process for producing the bag is also disclosed.

12 Claims, 6 Drawing Sheets

BAG FOR RETAINING WARMTH AND CRISPINESS OF FOOD ITEMS AND PROCESS THEREFOR

FIELD OF THE INVENTION

The present invention relates to the field of disposable bags for food items. More particularly, the invention relates to a bag suitable for the fast food industry, for retaining the warmth and crispiness of food items contained therein.

BACKGROUND OF THE INVENTION

Due to increased competition in the fast food industry, various types of food items have recently been introduced to the public. Many of these food items are intended to be eaten at the point of purchase while the food item is still warm. However, a significant percentage of food items that are sold are intended to be eaten at a later time, such as in an office or factory environment, or while traveling in a motor vehicle.

Disposable bags for packaging warmed fast food items are generally not provided with heat insulation, and quickly cool, to such an extent that the food items lose their appeal, including flavor and aroma. The inherent appeal of some of these recently introduced food items, or of well known food items such as baked goods, French fries and several types of sandwiches, is also associated with their crispiness. If such crispy food items are eaten at a later time, the residual oil or grease condensates, causing the food items to lose their external crisp texture and become soggy.

U.S. Pat. No. 6,187,396 discloses a bag for wrapping food items which is formed of a composite material including a first layer of cellulose-containing material and a second layer made of polyethylene. The composite material is formed with perforations that are pierced through the two layers. The ratio of open area to total area of the composite material is selected to maintain a controlled exchange of moisture from the interior to exterior of the bag.

Although this perforated bag is effective in terms of releasing a desired amount of moisture therefrom, which would condense if not released and compromise the crispiness of a food item, while preventing an excessive amount of moisture release, which would cause a baked good such as bread to become stale, the bag is ineffective in terms of retaining the warmth of the food item contained therein. A warm food item placed within the bag transfers heat by convection to the surrounding air within the bag. Since the perforations are pierced through the two layers of the composite material, the convected air, in addition to moisture, is released to the exterior of the bag via the perforations, thereby quickly cooling the food item.

U.S. Pat. No. 5,346,312 discloses a bag for maintaining cooked foods in a hot, crisp condition. The bag has a multi-ply film composite comprising a nonporous outer film ply made from a thermoplastic material and an inner porous film ply consisting of a blend of polyolefins. The plies are spaced so as to provide a gap in the form of a fluid reservoir for collecting and separating fluids from the food, in order to maintain food crispiness. The enclosed air space between adjacent film plies helps to limit heat loss from the food.

It would be desirable that fast food items be prepackaged, in order to achieve fast delivery of fast food items to consumers and efficient utilization of employees of a fast food enterprise. The preparation of many food items is time consuming, involving for example frying meat, cutting vegetables, and placing the same in a bun. The manipulation of a greasy food item is often more cumbersome, and is therefore even more time consuming. It is therefore desirable that the fast food items be prepared during periods of low customer volume, such as in the early morning hours, packaged in a suitable bag, and cooled in a refrigerator or frozen, whereupon the bags containing prepackaged food items are removed from cold storage and heated in an oven or in a microwave oven upon demand or during periods of high customer volume without involving a relatively long delay to a customer.

The bags of U.S. Pat. No. 6,187,396 and U.S. Pat. No. 5,346,312 are made of a thermoplastic material and therefore are not suitable for being heated in an oven or in a microwave oven. Additionally, thermoplastic materials are not biodegradable and involve cost expenditures for recycling these materials.

U.S. Pat. No. 3,628,720 discloses a bag having two plies of plastic sheet material, each ply having perforations which are offset from the perforations in the other ply. The perforations have the form of a tapered nozzle with its tapered end directed in the desired direction of air passage.

It is an object of the present invention to provide a bag and method for retaining the warmth and crispiness of food items containing therein for a useful period of time after delivery to a consumer.

It is an additional object of the present invention to provide a bag for packaging warmed fast food items that is disposable and biodegradable.

It is an additional object of the present invention to provide a bag for packaging warmed fast food items that can be heated in an oven or in a microwave oven.

It is yet an additional object of the present invention to provide a process for producing a bag in a simple, quick and economical manner.

Other objects and advantages of the invention will become apparent as the description proceeds.

SUMMARY OF THE INVENTION

The present invention provides a bag for retaining the warmth and crispiness of food items contained therein, comprising:

a) cellulose-based, oven-durable outer and inner plies which are at least partially adhesively affixed together by means of two or more of an upper transversal adhesive layer, a lower transversal adhesive layer, and at least one longitudinal adhesive layer;

b) a bag interior defined by adjacent faces of said inner ply; and c) at least one pocket formed between said outer and inner plies, each of said pockets being defined by at least one of the upper transversal adhesive layer and the lower transversal adhesive layer, and by two adjacent longitudinal adhesive layers;

wherein said outer and inner plies are pierced with a plurality of apertures such that the apertures pierced within said outer ply are offset from the apertures pierced within said inner ply by a predetermined dimension.

The term "longitudinal" refers to the general direction between the top and bottom edges of the bag. The term "transversal" refers to the general direction between side edges of the bag.

A backflow of vapors from said at least one pocket to said bag interior is prevented due to the higher temperature of said interior with respect to said at least one pocket. After said interior, said at least one pocket and the bag exterior come to thermal equilibrium, fresh air flows from the bag exterior to the bag interior via the apertures of the outer ply and of the inner ply, thereby preventing the food item from becoming stale.

The inner and outer plies, which are preferably grease resistant, are heat-resistant when exposed to a heating temperature ranging from approximately 200° C. to 280° C. during a heating period ranging from approximately 1 to 200 minutes and are durable to the food heating conditions within a microwave oven.

The bag of the invention is suitable for retaining the warmth of food items such as French fries, baked goods, pizza, and sandwiches contained therein.

Preferably, the diameter of each aperture ranges from approximately 0.3 to 3 mm, the spacing between adjacent apertures ranges from approximately 4 to 30 mm, and the predetermined offset dimension between an aperture of the outer ply and a corresponding aperture of the inner ply ranges from approximately 2 to 15 mm.

Preferably, the inner ply has a weight density ranging from approximately 40 to 60 g/m$^2$ and the outer ply has a weight density ranging from approximately 50 to 80 g/m$^2$.

In one aspect, the bag has at least one non-pierced region. One non-pierced region is coincident with a lower flap affixed to the outer ply.

In one aspect, the bag has two opposed longitudinal folds.

In one aspect, the bag has a central open portion formed between two front face portions, a food item inserted into said central open portion being retained by a lower flap affixed to said two front face portions and by a bag rear face.

The present invention is also directed to a process for producing two-ply warmth and crispiness-retaining bags, comprising the steps of a) optionally initially feeding pierced cellulose-based, oven-durable outer and inner sheets to corresponding upper transversal adhesive layer applying stations;
b) feeding said inner and outer sheets to corresponding longitudinal adhesive layer applying stations;
c) affixing said inner and outer sheets together such that the corresponding upper transversal and longitudinal adhesive layers of said inner and outer sheets are aligned and that the apertures pierced with said outer sheet are offset from the apertures pierced within said inner sheet by a predetermined dimension, whereby to produce two-ply sheet material;
d) feeding said two-ply sheet material to a longitudinal folding station, whereby to form longitudinal folds which define front and rear faces of a bag;
e) feeding said sheet material to a cutting station; and
f) feeding said cut sheet material to a lower flap forming station for folding and adhering the lower edge of said cut sheet material, whereby to form a plurality of pockets between said cut inner and outer sheets.

In one embodiment of the invention, the outer and inner sheets are pierced offline, such as by a piercing station.

In another embodiment of the invention, the outer and inner sheets are pierced in-line. Accordingly, the process further comprises the step of feeding the outer and inner sheets to a corresponding piercing station prior to being fed to corresponding upper transversal adhesive layer applying stations.

Each piercing station preferably comprises a needle roller and means for reciprocating said needle roller, the needle roller of each piercing station being reciprocated by a different reciprocating cycle to produce non-pierced regions within said outer and inner sheets. The needle roller may be reciprocated by means of a piston-based actuator or by means of a linear motor.

In one aspect, transversal ends of the outer sheet are affixed to each other and transversal ends of the inner sheet are affixed to each other prior to the step of feeding the two-ply sheet material to the longitudinal folding station.

In one aspect, two spaced front face portions defining a central open portion therebetween are also formed at the longitudinal folding station and a lower flap capable of retaining a food item inserted in said central open portion is formed at the lower flap applying station. A longitudinal adhesive layer of a controllable length is applied to the front face portions prior to being fed to the lower flap applying station.

The process is suitable for producing 30 to 500 bags per minute.

Preferably, the feeding rate of the outer and inner sheets is essentially equal.

Preferably, the outer sheet is fed to a printing station prior to being pierced.

The present invention is also directed to a method for retaining the warmth and crispiness of food items contained therein, comprising:

i. providing cellulose-based, oven-durable outer and inner plies which are at least partially adhesively affixed together by means of two or more of an upper transversal adhesive layer, a lower transversal adhesive layer, and at least one longitudinal adhesive layer, wherein said outer and inner plies are pierced with a plurality of apertures such that the apertures pierced with said outer ply are offset from the apertures pierced within said inner ply by a predetermined dimension;
ii. providing at least one pocket formed between said outer and inner plies, each of said pockets being defined by at least one of the upper transversal adhesive layer and the lower transversal adhesive layer, and by two adjacent longitudinal adhesive layers; and
iii. introducing a warmed food item into a bag interior defined by adjacent faces of said inner ply;

whereby vapors emitted by said warmed food item are driven into said at least one pocket via said apertures formed in the inner ply by means of the temperature differential between said interior and said at least one pocket and remain within said at least one pocket for a useful period of time.

The term "useful period of time" refers to a time period of between 5 and 30 minutes, and preferably between 10 and 15 minutes.

In one aspect, the method further comprises the steps of providing a bag having a central open portion formed between two front face portions; inserting a food item inserted into said central open portion such that it is retained by a lower flap affixed to said two front face portions and by a bag rear face; and folding said bag at a fold line above the food item to form a food insulating top flap.

DETAILED DESCRIPTION OF PREFERRED EMBODIMENTS

The present invention is a novel disposable bag for retaining the warmth and crispiness of food items, such as French fries, baked goods, and sandwiches, contained therein. While prior art bags for packaging warmed fast food items bag are made of a thermoplastic material, the bag of the present invention is made from a material can be heated in an oven or in a microwave oven. The waiting time for delivery of the fast food items to customers is therefore reduced, since the fast food items may be prepackaged and subsequently quickly heated upon demand.

Figure 1:
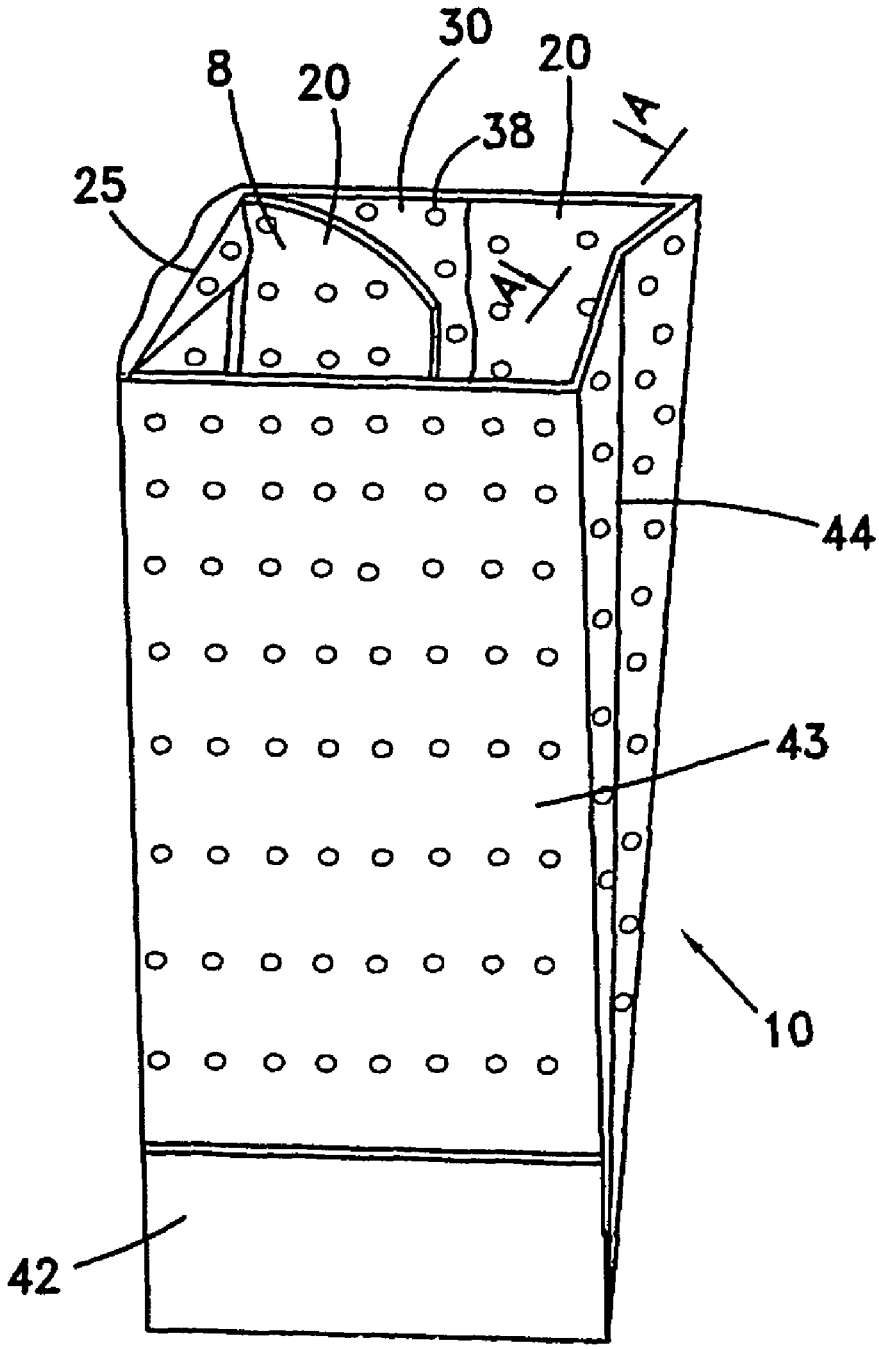
FIG. 1 is a perspective, partially fragmented view from the rear of a bag according to one embodiment of the invention.
Figure 2:
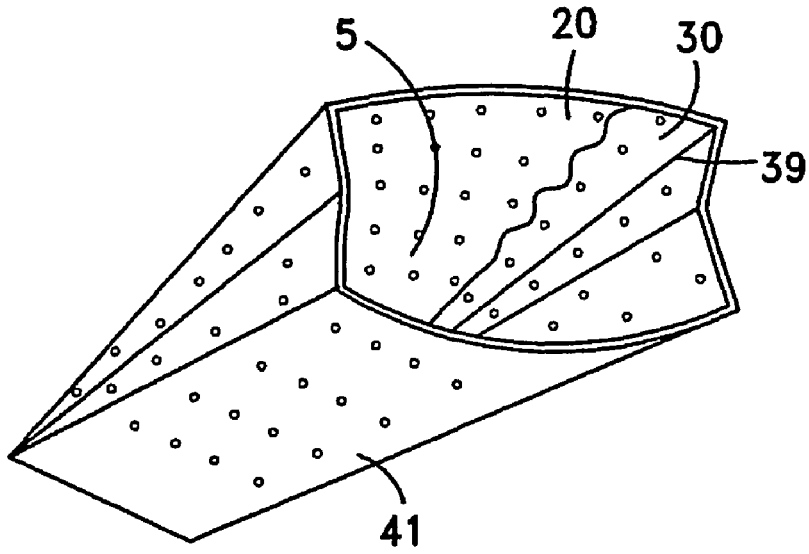
FIG. 2 is a perspective, partially fragmented view from the front of the bag of FIG. 1.
Figure 3:
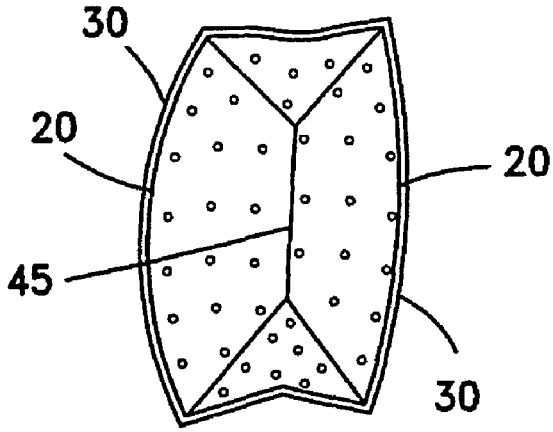
FIG. 3 is a top view of the bag of FIG. 1.

FIGS. 1-3 illustrate a bag, according to one embodiment of the invention, which is generally designated by numeral 10. FIGS. 1 and 2 are perspective, partially fragmented views of the bag, while FIG. 3 is a top view thereof. Bag 10 comprises two biodegradable, paper plies 20 and 30. Inner ply 20 is pierced with a plurality of apertures 8, and outer ply 30 is pierced with a plurality of apertures 38 such that apertures 38 are offset from apertures 8 by a predetermined dimension. Paper plies 20 and 30, which are preferably grease-resistant, are heat-resistant when exposed to a food-heating temperature, such as by reheating, ranging from 200-280° C. during a heating period ranging from 1-200 minutes within a conventional oven and are durable to the food heating conditions within a microwave oven. Inner ply 20 has a weight density ranging e.g. from 40-60 g/m$^2$, and outer ply 30 is generally thicker than inner ply 20, having a weight density ranging e.g. from 50-80 g/m$^2$, for providing improved insulation to food items placed within interior 5 of bag 10.

Apertures 8 of inner ply 20 and apertures 38 of outer ply 30 are preferably pierced by an arrangement of parallel rows. In each of inner ply 20 and outer ply 30, adjacent apertures of different rows may be collinear with respect to a line perpendicular to the edge of the corresponding ply or with respect to a line oblique to the edge of the corresponding ply, or may be pierced by any other suitable arrangement. The diameter of each aperture ranges e.g. from 0.3-3 mm and the spacing between adjacent apertures ranges e.g. from 4-30 mm. The ratio of the open area, corresponding to the area enclosed within the periphery of the apertures, to the total area enclosed by the edges of outer ply 30 or of inner ply 20 is selected to maintain a controlled exchange of moisture from the interior to exterior of bag 10.

Figure 4:
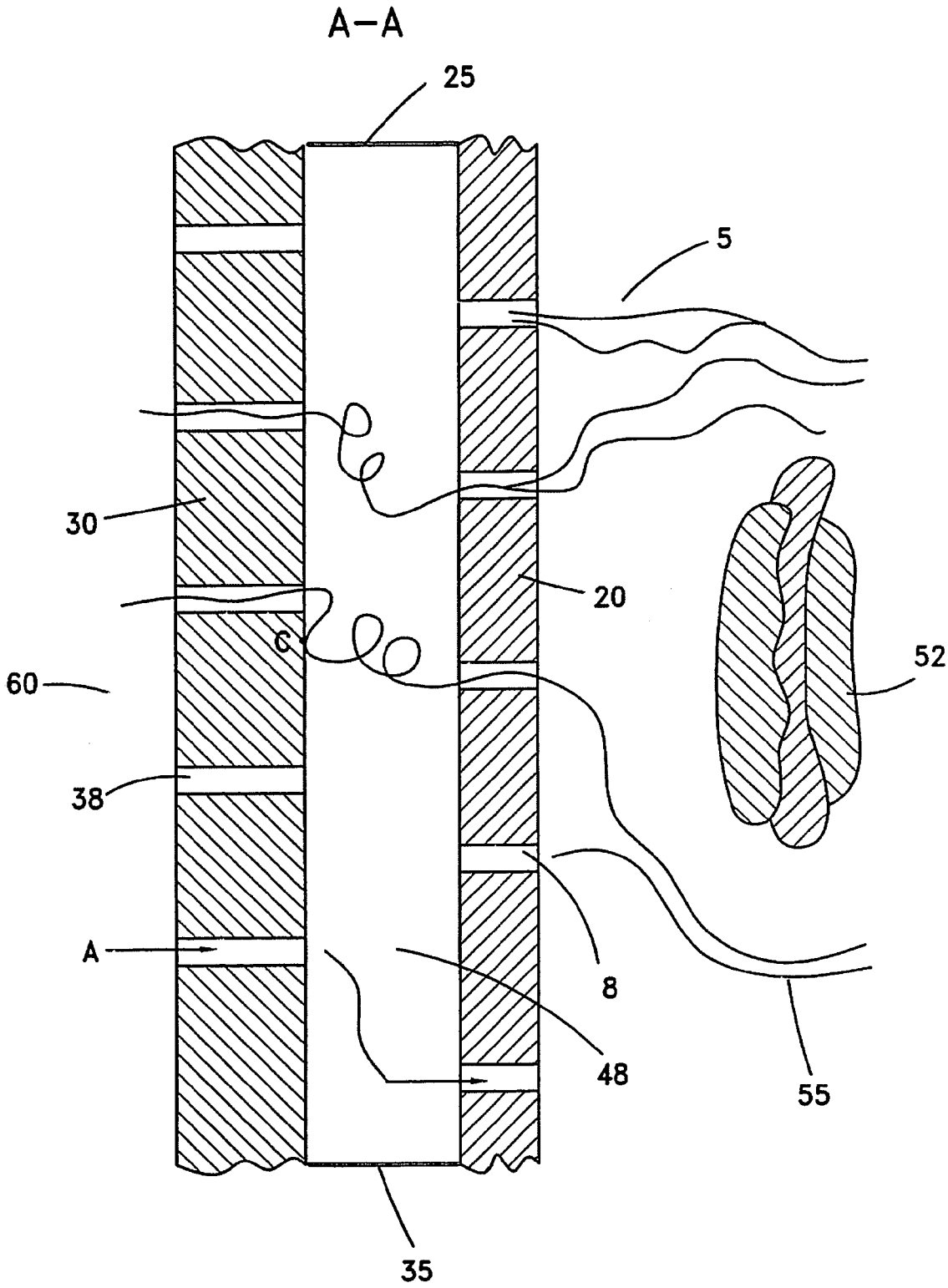
FIG. 4 is a cross sectional view cut about plane A-A of FIG. 1, showing the flow of vapors from a heated food item within the interior of the bag to a heat insulating pocket.

Inner paper ply 20 and outer paper ply 30 are affixed together by means of upper transversal adhesive layer 25 and lower transversal adhesive layer 35 (FIG. 4). Lower transversal adhesive layer 35 is applied to folded flap 42 of plies 20 and 30 and to the corresponding region of outer ply 30. After flap 42 is folded and lower adhesive layer 35 is applied, junction line 45 is formed between adjacent faces of inner ply 20, as shown in FIG. 3. The lower region of inner ply 20 and outer ply 30 in the vicinity of flap 42 are advantageously produced without apertures, to prevent passage of paste therethrough during the production of the bag. The two plies 20 and 30 are also affixed together by a plurality of longitudinal adhesive layers 39, one of which being shown. Bag 10 is also formed with two longitudinal folds 44, which define front face 41 and rear face 43 of outer ply 30 between the two longitudinal folds 44. Bag 10, including the cutting of plies 20 and 30 to selected dimensions, formation of apertures 8 and 38, and the application of adhesive layers 25, 35, and 39, may be produced manually or by the automatic process that will be described hereinafter.

As shown in the schematic cross sectional drawing of FIG. 4, a pocket 48, which is defined by upper adhesive layer 25 and lower adhesive layer 35 as well as by adjacent longitudinal adhesive layers, is produced between outer ply 30 and inner ply 20. The wall of each aperture 8 of inner ply 20 may be produced such it protrudes slightly, e.g. a protrusion of up to 0.5 mm, into pocket 48 (not shown). Consequently the minimum gap between inner ply 20 and outer ply 30 is equal to the protrusion of the aperture wall.

Following insertion of heated sandwich 52, or any other heated food item, into interior 5 of the bag, warm vapors 55 emitted by sandwich 52, as well as the air surrounding the latter and heated thereby by convection and to a lesser degree by radiation, are driven into pocket 48 via apertures 8 formed in inner ply 20 by means of the temperature differential between interior 5 of the bag and pocket 48. Vapors 55 are prevented from being immediately discharged to exterior 60 of the bag since they contact a corresponding surface area of outer ply 30, as indicated by point C. Since the temperature differential between pocket 48 and exterior 60 is less than the temperature differential between interior 5 and pocket 48, vapors 55 remain within pocket 48 for a minimum residing time of 15 minutes. During this minimum residing time, vapors 55 are gradually discharged from pocket 48 to exterior 60 via apertures 38 of outer ply 30 while providing thermal insulation to interior 5 and to sandwich 52 contained therein. A backflow of vapors from pocket 48 to interior 5 is prevented due to the higher temperature of interior 5 with respect to pocket 48. After interior 5, pocket 48 and exterior 60 come to thermal equilibrium, fresh air A flows from exterior 60 to interior 5 via apertures 38 of outer ply 30 and apertures 8 of inner ply 20, thereby preventing sandwich 52 from becoming stale.

Figure 6:
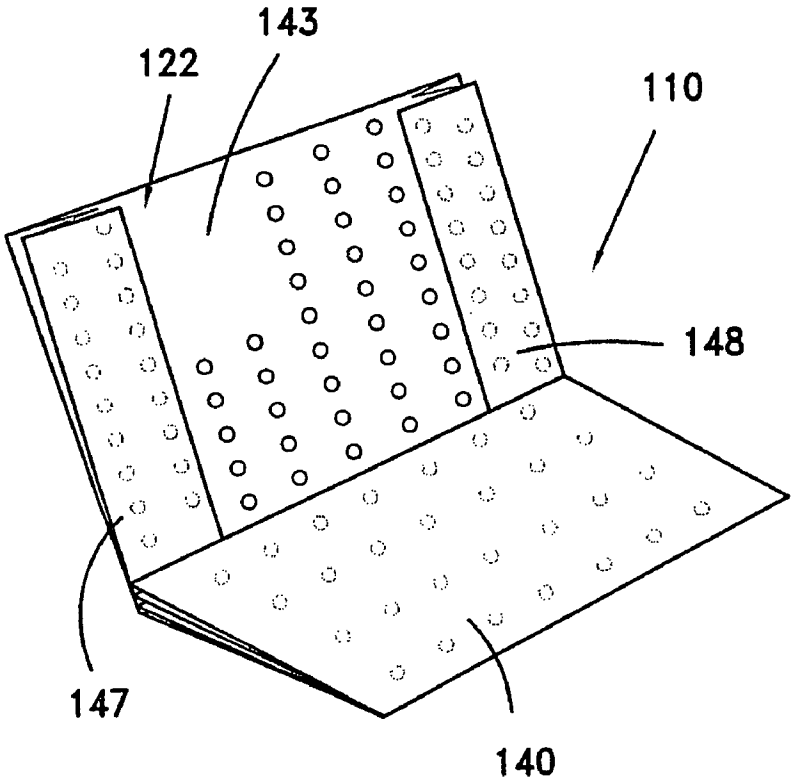
FIG. 6 is a perspective view from the front of a bag according to another embodiment of the invention.

FIG. 6 illustrates another embodiment of a warmth and crispiness-retaining bag, which is generally designated by numeral 110, having a front face with a central open portion 122. The configuration of bag 110 advantageously allows a consumer to eat a greasy food item without being soiled by the residual grease.

Figure 7:
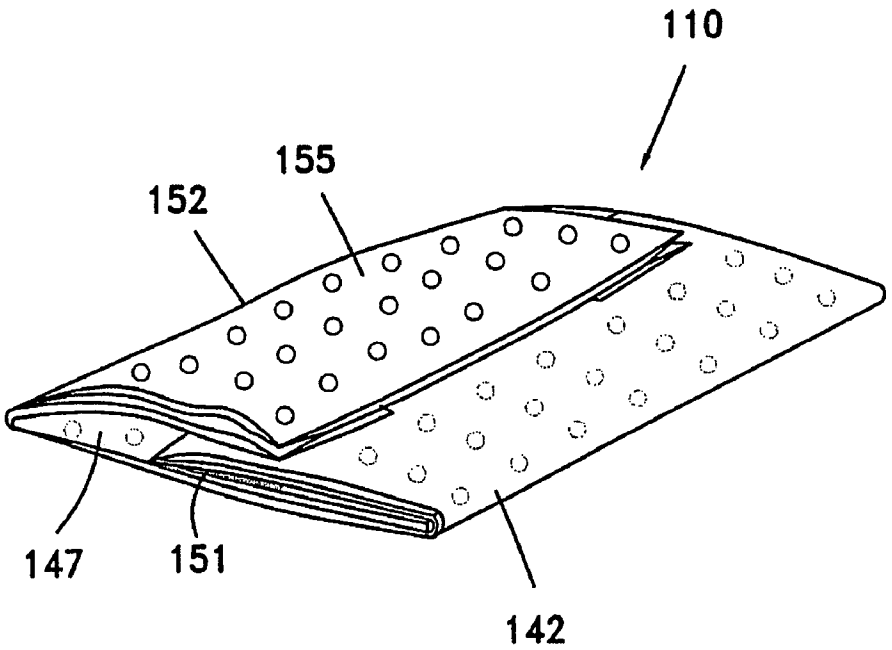
FIG. 7 is a perspective view from a front side of the bag of FIG. 6, illustrating a food insulating top flap.

While the width of rear face 143 is equal to the width of bag 110, the front face is defined by two separated portions 147 and 148. Bag 110 has a lower flap 142 which has a considerably longer longitudinal dimension than that of lower flap 42 of bag 10 shown in FIG. 1. After being folded, lower flap 142 is adhered to front face portions 147 and 148 by corresponding longitudinal adhesive layers 151 (FIG. 7). If so desired, the consumer may personally affix lower flap 142 to front face portions 147 and 148, e.g. by first peeling a protection layer (not shown) covering the corresponding adhesive layer. A food item inserted into central open portion 122 is retained by enlarged lower flap 142 and by rear face 143 of bag 110. While holding bag 110 at lower flap 142, the portion of the food item protruding from lower flap 142 may be eaten without having to fold rear face 142 and without being soiled by the residual grease. In this embodiment, lower flap 142 is pierced with a plurality of apertures 138, to retain the warmth and crispiness of the food item retained by lower flap 142.

As shown in FIG. 7, bag 110 may be folded at fold line 152 above the food item to form a food insulating top flap 155 when the food item is not being eaten.

It will be appreciated that in this embodiment, an upper transversal layer does not necessarily have to be applied to the outer and inner plies which comprise bag 110. When food insulating top flap 155 is folded as shown, the bag interior defined by lower flap 142, rear face 143, and upper flap 155 constitutes a pocket for retaining the warmth and crispiness of a food item contained therein.

Figure 5:
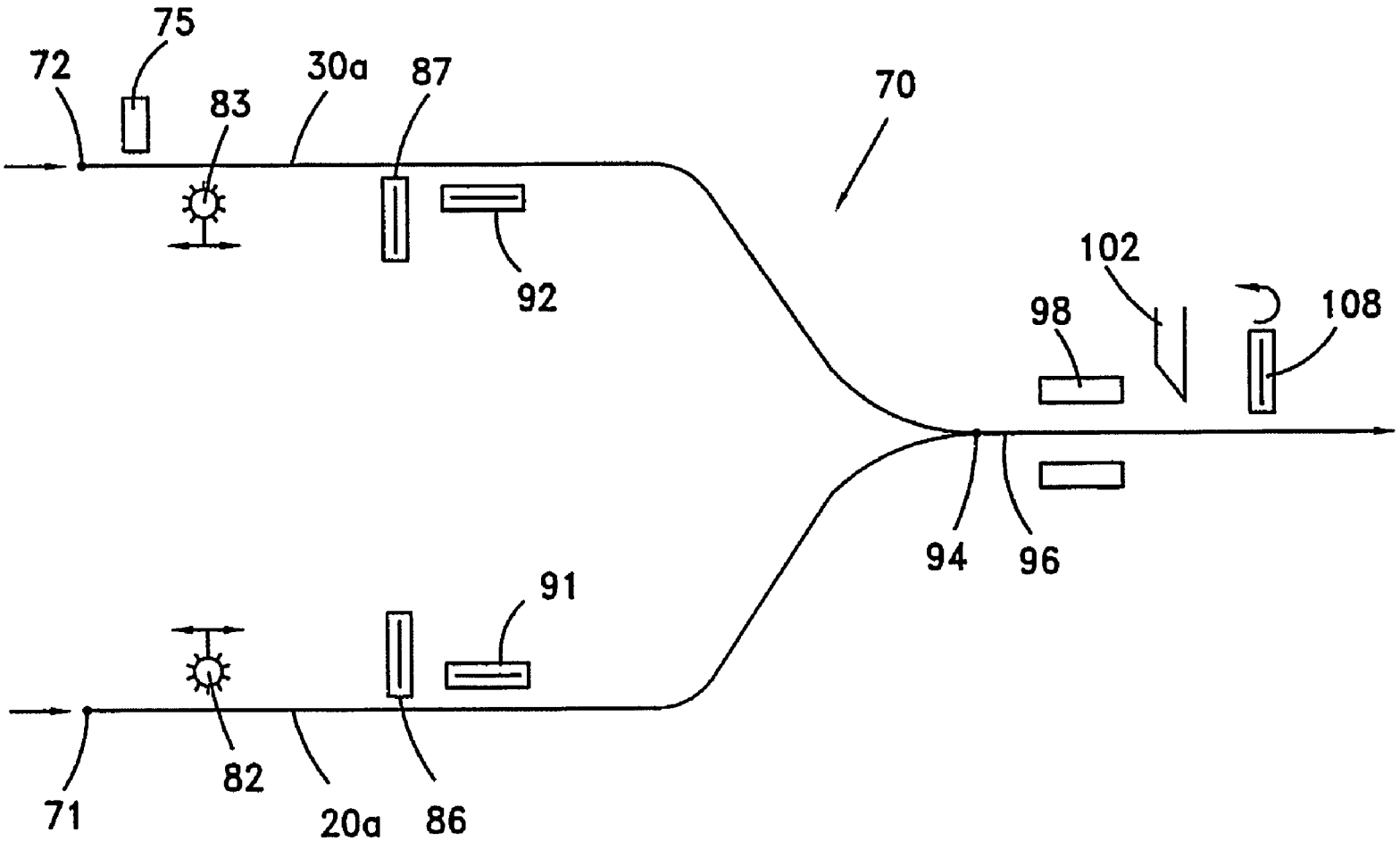
FIG. 5 is a schematic drawing of a process for producing a bag, according to one embodiment of the invention.

FIG. 5 illustrates a process, which is generally designated by numeral 70, according to one embodiment of the invention, for producing two-ply biodegradable, warmth and crispiness-retaining bags. Since the apertures of the outer ply are offset from the apertures of the inner ply by a predetermined dimension, as described hereinabove, the apertures of the two plies, as well as other steps of the process, are preferably produced simultaneously to ensure reliability of the process. If so desired, the apertures may be pierced offline, i.e. prior to the automatic feeding of the two plies to the remaining stations of the process. It is preferable, however, that the apertures be pierced in-line, i.e. when the two plies are continuously fed from a piercing station to the remaining stations of the process, so that one of the plies would not be stretched more than the second ply. If one of the plies is stretched more than the second ply, the predetermined aperture offset dimension may not be achieved, thereby affecting the residing time of vapors emitted by a food item to the pockets of the bag and therefore the insulating capability of the bag.

In the illustrated in-line process, two sheets 20*a* and 30*a*, from which the inner ply and outer ply, respectively, of the bag are produced, are continuously fed from a roll to starting points 71 and 72, respectively. Sheets 20*a* and 30*a* are shown to be fed by a laterally spaced arrangement, but it will be appreciated that the two sheets may be fed by a vertically spaced arrangement, or by any other suitable arrangement that allows the bags to be effectively and efficiently produced.

From starting point 72, outer sheet 30*a* is fed to printing station 75 and is custom printed on the outer face thereof, i.e. on the face which is visible to one holding the bag. From printing station 75, outer sheet 30*a* is fed to piercing station 83. Inner sheet 20*a* is fed directly from starting point 71 to piercing station 82. The feeding rate of inner sheet 20*a* and outer sheet 30*a* is essentially equal. Each piercing stations 82 and 83 includes a needle roller and means for reciprocating the corresponding needle roller, e.g. by means of a piston actuator or a linear motor. The needle roller of each piercing station is reciprocated by a similar cycle, with a time difference between the reciprocating cycle of each needle roller, so that regions of the sheets will remain without apertures. Inner sheet 20*a* and outer sheet 30*a* are fed to upper transversal adhesive layer applying stations 86 and 87, respectively, and then to longitudinal adhesive layer applying stations 91 and 92, respectively.

Inner sheet 20*a* and outer sheet 30*a* are adhered to each other at affixation point 94, such that the corresponding upper transversal and longitudinal adhesive layers of the two sheets are aligned, to produce two-ply sheet material 96. Two-ply sheet material 96 is then fed to longitudinal folding station 98, whereat a static guide element pressing on a corresponding side of sheet material 96 form longitudinal folds, which define the front and rear faces of the bag. Sheet material 96 is then fed to cutting station 102, e.g. a guillotine-type cutter. The cut sheet material is fed to lower flap forming station 108, which is adapted to fold the lower edge of the cut sheet material by one or two folds and to adhere the formed flap to the outer ply. As the flap adheres to the outer ply, a plurality of pockets are formed between the inner and outer plies, the number of pockets that are formed being dependent on the number of applied longitudinal adhesive layers, and a junction line is formed between adjacent faces of the inner ply.

The transversal adhesive layers may be applied by means of a planar toothed applicator that is immersed in a paste and rotated. The longitudinal adhesive layers may be applied by a sprayed stream of paste.

Figure 8:
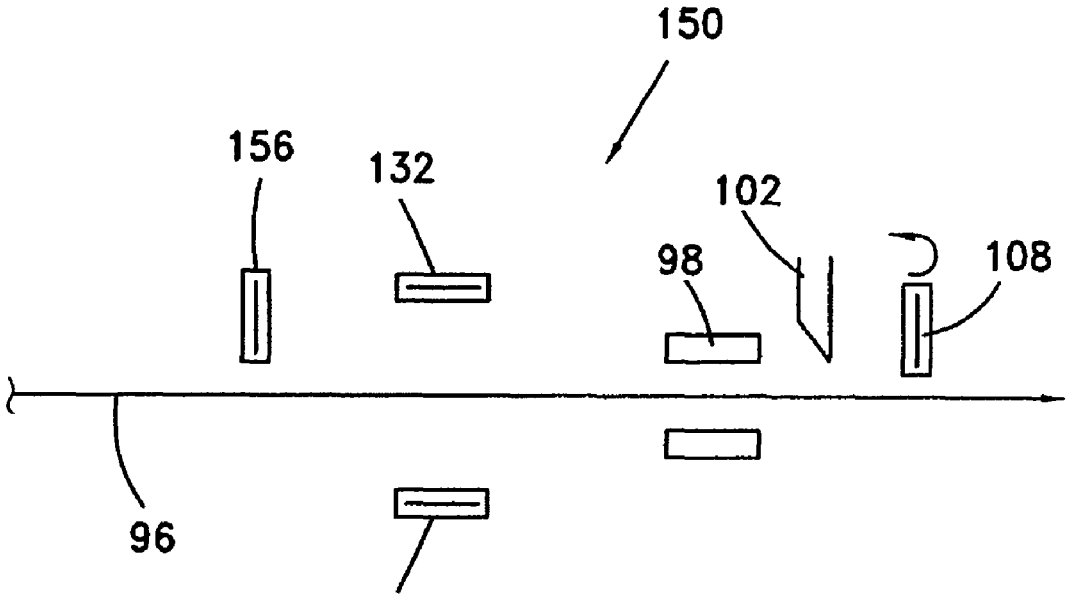
FIG. 8 is a schematic drawing of a process for producing a bag according to another embodiment of the invention, illustrating steps not shown in FIG. 5.

FIG. 8 illustrates a process 150 for producing a bag 10 of FIG. 1 having front and rear faces of equal width, in addition to the steps illustrated in FIG. 5. While the inner and outer sheets are longitudinally aligned, they are not transversally aligned. Prior to being fed to longitudinal folding station 98, two-ply sheet material 96 is fed to longitudinal adhesive layer applying stations 131 and 132, respectively. Longitudinal adhesive layer applying station 131 applies an adhesive in the vicinity of one transversal edge of the inner sheet, and longitudinal adhesive layer applying station 132 applies an adhesive to the vicinity of one transversal edge of the outer sheet. Two-ply sheet material 96 is then fed to bonding station 156, e.g. a press being alternately upwardly and downwardly vertically displaced, so that the two transversal ends of the inner sheet are affixed to each other and the two transversal ends of the outer sheet are affixed to each other, to produce a continuous two-ply sheet. The continuous two-ply sheet is then fed to longitudinal folding station 98, cutting station 102, and lower flap forming station 108 to finalize the production of a bag 10.

Figure 9:
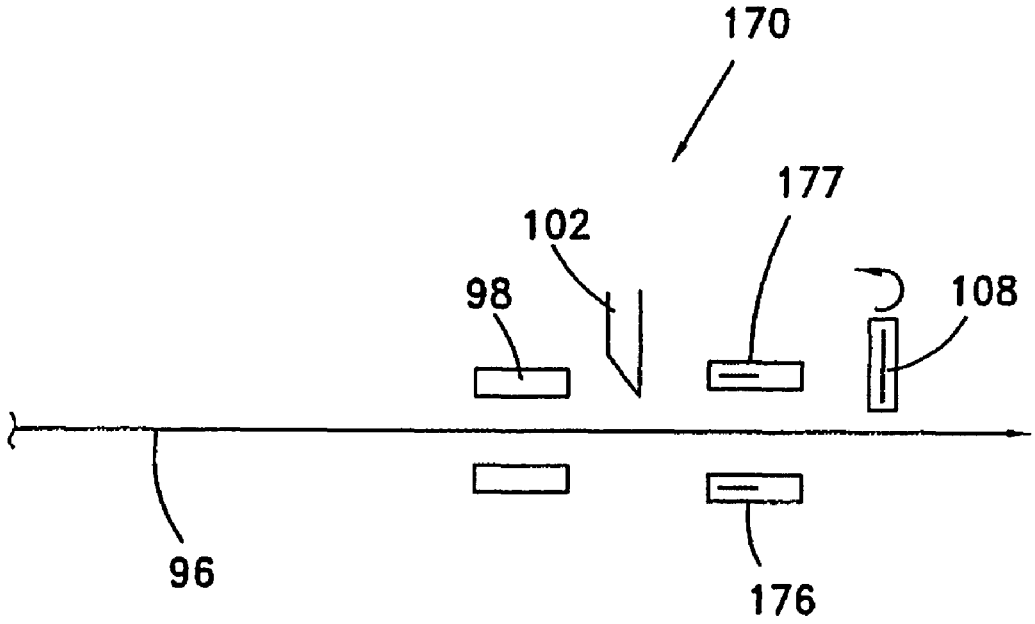
FIG. 9 is a schematic drawing of a process for producing a bag according to another embodiment of the invention, illustrating a step not shown in FIG. 5.

FIG. 9 illustrates a process 170 for producing a bag 110 of FIG. 6 having a front face with a central open portion, in addition to the steps illustrated in FIG. 5. The inner and outer sheets are longitudinally and transversally aligned, and are sized such that the two spaced front face portions are also formed at longitudinal folding station 98 and such that an enlarged lower flap is formed at lower flap forming station 108. Prior to being fed to lower flap forming station 108, the longitudinally folded two-ply sheet material 96 is fed to longitudinal adhesive layer applying stations 176 and 177. At stations 176 and 177, a longitudinal adhesive layer 151 (FIG. 7) of a controllable length is applied to front face portions 147 and 148 (FIG. 6), so that when folded at station 108, lower flap 142 will be able to be affixed to front face portions 147 and 148. A longitudinal adhesive layer of a controllable length is applied to the front face portions by means of an encoder mounted on the shaft of the feeding device. A paste applicator is intermittently actuated when the feeding device shaft is rotated to a predetermined circumferential angle.

EXAMPLE 1

Sheet material was fed at a rate sufficient to produce 60 bags per minute. The outer and inner plies were made from grease-resistant Olean paper manufactured by Papeteries De Gascogne, France, which is resistant to a food-heating temperature of 220° C. for a period of 6 minutes within a conventional oven. The inner ply had a weight density ranging of 40 g/m$^2$ and the outer ply had a weight density of 70 g/m$^2$. The longitudinal adhesive layer was applied by adhesive A23K1 and the transversal adhesive layers were applied by adhesive A10K4, both of which manufactured by the Henkel Group, Germany. An additional transversal adhesive layer was applied between a lower flap and the outer ply.

The apertures of the inner and outer plies were pierced by a needle roller in an arrangement of parallel rows. The diameter of each aperture was approximately 1.7 mm. The spacing between adjacent apertures on the same row was approximately 20 mm, and the spacing between adjacent apertures on different rows was approximately 14 mm. The needle rollers having a needle diameter of 2 mm were reciprocated by means of a piston actuator so as to produce regions having a width of 3 cm from the top and bottom edge of the bag, respectively, without apertures.

EXAMPLE 2

A bag having a front face with a central open portion was produced. The longitudinal dimension of the bag was 24 cm and of the lower flap was 10 cm. The width of each front face portion was 4 cm. A longitudinal adhesive layer of 5 cm was applied to each front face portion. A paste gun was intermittently actuated such that a 5-cm length of paste corresponding to the location of the lower flap to be folded was applied to each front face portion, and was then intermittently deactivated for a longitudinal length of 19 cm, so that the lower flap of each bag would be able to be sequentially affixed to the corresponding front face portions. The actuation and deactivation of the paste gun was controlled by means of an encoder mounted on the shaft of the feeding device.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

I claim:

1. A bag for retaining the warmth and crispiness of food items contained therein, comprising:

a) cellulose-based, oven-durable outer and inner plies which are at least partially adhesively affixed together by means of two or more of an upper transversal adhesive layer, a lower transversal adhesive layer, and at least one longitudinal adhesive layer;

b) a bag interior defined by adjacent faces of said inner ply; and c) at least one pocket formed between said outer and inner plies, each of said pockets being defined by at least one of the upper transversal adhesive layer and the lower transversal adhesive layer, and by two adjacent longitudinal adhesive layers;

wherein said outer and inner plies are pierced with a plurality of apertures such that the apertures pierced within said outer ply are not aligned with the apertures pierced within said inner ply and that the apertures pierced within said outer ply are offset from the apertures pierced within said inner ply by a predetermined dimension.

2. The bag according to claim 1, wherein the predetermined offset dimension between an aperture of the outer ply and a corresponding aperture of the inner ply ranges from approximately 2 to 15 mm.

3. The bag according to claim 2, wherein the diameter of each aperture ranges from approximately 0.3 to 3 mm.

4. The bag according to claim 2, wherein the spacing between adjacent apertures ranges from approximately 4 to 30 mm.

5. The bag according to claim 1, wherein the inner and outer plies are heat-resistant when exposed to a heating temperature ranging from approximately 200° C. to 280° C. during a heating period ranging from approximately 1 to 200 minutes and are durable to the food heating conditions within a microwave oven.

6. The bag according to claim 1, wherein the inner ply has a weight density ranging from approximately 40 to 60 $g/m^2$ and the outer ply has a weight density ranging from approximately 50 to 80 $g/m^2$.

7. The bag according to claim 1, wherein the inner and outer plies are grease resistant.

8. The bag according to claim 1, wherein the bag has at least one non-pierced region.

9. The bag according to claim 8, wherein one non-pierced region is coincident with a lower flap affixed to the outer ply.

10. The bag according to claim 1, wherein the bag has two opposed longitudinal folds.

11. The bag according to claim 1, wherein warm vapors emitted by a heated food item inserted in the bag interior are driven into the at least one pocket via the apertures pierced within the outer ply by means of the temperature differential between the bag interior and the at least one pocket and remain within the at least one pocket for a minimum residing time of 15 minutes, for thermally insulating and retaining the crispiness of said heated food item, said food item being selected from the group consisting of French fries, baked goods, fried foods, pizza, and sandwiches.

12. The bag according to claim 1, which has a central open portion formed between two front face portions, a food item inserted into said central open portion being retained by a lower flap affixed to said two front face portions and by a bag rear face.

* * * * *